United States Patent [19]

Medin et al.

[11] Patent Number: 4,881,448

[45] Date of Patent: Nov. 21, 1989

[54] REACTIVE ARMOR ARRANGEMENT

[75] Inventors: Gunnar Medin; Erik Olsson; Lennart Sjöö, all of Eskilstuna; Roger Lundgren, Bromma, all of Sweden

[73] Assignee: Affarsverket FFV, Eskilstuna, Sweden

[21] Appl. No.: 124,989

[22] PCT Filed: Mar. 16, 1987

[86] PCT No.: PCT/SE87/00131

§ 371 Date: Nov. 24, 1987

§ 102(e) Date: Nov. 24, 1987

[87] PCT Pub. No.: WO87/05993

PCT Pub. Date: Oct. 8, 1987

[30] Foreign Application Priority Data

Mar. 27, 1986 [SE] Sweden ..... 8601435

[51] Int. Cl.[4] ..... F41H 5/04

[52] U.S. Cl. ..... 89/36.02; 109/26; 109/49.5

[58] Field of Search ..... 89/36.02, 36.17; 428/911; 109/26, 27, 49.5

[56] References Cited

U.S. PATENT DOCUMENTS

| | | | |
|---|---|---|---|
| 3,793,648 | 2/1974 | Dorre et al. | 89/36.02 |
| 3,962,976 | 6/1976 | Kelsey | 89/36.02 |
| 4,161,125 | 7/1979 | Degnan | 89/36.02 |
| 4,364,300 | 12/1982 | Pagano et al. | 89/36.02 |
| 4,368,660 | 1/1983 | Held | 89/36.17 |

FOREIGN PATENT DOCUMENTS

| | | | |
|---|---|---|---|
| 2201637 | 8/1973 | Fed. Rep. of Germany | 89/36.02 |
| 525818 | 8/1921 | France | 89/36.02 |

*Primary Examiner*—Deborah L. Kyle
*Assistant Examiner*—Stephen Johnson
*Attorney, Agent, or Firm*—Fleit, Jacobson, Cohn, Price, Holman & Stern

[57] ABSTRACT

A reactive armor arrangement consisting of two mutually parallel metal sheets with an interior sheet of incompressible formaldehyde compound. Upon impact with a hollow jet explosive charge, the incompressible layer causes the outer metal sheets to push outwardly into the path of the hollow jet explosive charge.

5 Claims, 2 Drawing Sheets

REACTIVE ARMOR ARRANGEMENT

TECHNICAL FIELD

The present invention relates to reactive or "dynamic" protective armour arrangements for protection against obliquely impinging hollow explosive charge jets. The armour arrangement comprises two mutually spaced metal plates, which can be penetrated by an impinging hollow explosive charge jet to form a hole in the plates, and further comprises an intermediate layer of non-explosive material located between the plates.

BACKGROUND PRIOR ART

One such reactive armour arrangement is known from U.S. Pat. No. 4,368,660. Incorporated between the plates f this known arrangement is an explosive substance which will detonate when a hollow charge jet or like projectile impinges on the reactive armour arrangement, the subsequent detonation pressure causing the two plates to move away from each other and therewith greatly degrade the hollow charge jet.

The plates of such protective armour arrangement, however, need to be relatively large in order to function effectively, and consequently commensurately large quantities of explosive must be used in order to achieve the effect desired. One drawback in this regard is that the explosive forces generated by such large quantities of explosive are liable to result in damage to the object protected by the arrangement (e.g. an armoured vehicle or tank).

SUMMARY OF THE INVENTION

The object of the present invention is therefore to provide a reactive armour arrangement of the aforesaid kind which does not require the use of an explosive charge to fulfill its protective function.

This object is achieved with a reactive armour arrangement having the inventive features set forth in the characterizing clause of the following claim 1.

Further developments of the invention are set forth in the depending claims.

The invention is based on the discovery that the intrinsic energy of the hollow explosive charge jet in itself can be used to create shockwaves of different pressures in the plates and in an interlayer of the reactive armour arrangement. The pressure differentials created result in two counter-directional forces which tend to move the plates away from one another, in a manner which causes fresh plate material to be moved progressively into the path of the hollow explosive charge jet, thereby reducing the energy of the jet.

Compressible materials such as, e.g. rubber, or gases, e.g air, cannot be used to form the interlayer since almost all of the energy present in the shockwaves is dissipated in dislodging or punching material from the plates. The interlayer material should therefore be incompressible and possess a high dynamic mechanical strength.

The physical explanation of the shockwave effect is that practically total reflection of a shockwave takes place when the shockwave moves from a medium of relatively high density to a medium of lower density. Thus, in the case of the inventive protective arrangement, an impinging hollow charge jet will initiate in the outer plate a first shockwave which is reflected towards the thinner interlayer, this procedure being repeated some microseconds later behind the tip of the jet or thorn in the inner plate. This results in two forces which act in mutually opposite directions and which tend to draw the plates apart. It has optimal shockwave effect is obtained when the interlayer comprises an incompressible material and has a density which is at most $\frac{1}{3}$ of the density of the plates.

The hollow charge jet will create in the protective armour arrangement a hole which is inversely proportional to the flow stress of the outer material and which is greater than the diamater of the hollow charge jet. Due to the aforesaid counter-direction forces, the edges around the hole will be lifted to form a bulged or crater-like surround, such that the plate material around the hole will move progressively into the path of the obliquely impinging jet, thereby causing the jet to penetrate further material with a subsequent decrease in jet energy.

The invention can also be explained in terms of shockwave pressure. For example, it has been established experimentally that when the shockwave pressure in the plates is $p_1$ pressure nits and the shockwave pressure in the interlayer is $p_2$ pressure units, the optimal outward bulging or lifting of the plate material surrounding the hole is obtained when $p_1/p_2$=about 7. An acceptable outward lifting of the hole-defining edges is obtained within the range $2<p_1/p_2<12$.

Thus, the energy transmitted from the hollow charge jet to the protective armour arrangement (excluding the penetration energy) is converted to kinetic energy for movement of the armour plates, which therewith expand at a certain velocity. The rate of expansion increases with the energy content of the jet tip or thorn, but decreases with the mass of the outer plates.

Degradation ceases when the jet no longer touches the protective armour, this loss of contact possibly being due to the fact that the plate have been lifted sufficiently in the region of the hole-defining edges thereof, or because the plates have ceased to expand.

The plates will suitably have a thickness between 2 and 20 mm, preferably between 2 and 10 mm, in order to ensure that the hole-defining edges will be lifted or upwardly bulged, to the extend desired, i.e. to ensure that sufficient plate material is shifted into the path of the hollow charge jet.

The plates are preferably joined together by strips which function as hinges and which concentrate the rate of expansion for the protective armour to the region thereof around the entrance hole. It has been found in practice, however, that the plate material located in the vicinity of the hole will tend to lift even when the plates are not connected together with the aid of such strips, thereby indicating that their presence is not absolutely necessary.

In order to degrade effectively the hollow charge jet, the plates should exhibit high dynamic mechanical strength, a high density, and have a high expansion rate. According to one preferred inventive feature the plates have a density greater than $4 \cdot 10^3$ kg/m$^3$, and preferably greater than $7 \cdot 10^3$ kg/m$^3$. The plates may suitably comprise, e.g., steel and tungsten, which together with, e.g., ethylene plastic in the interlayer satisfactorily fulfills the aforesaid conditions.

The dynamic yield point or flow stress $\sigma_{0.2}$ of the inventive plate material should, in accordance with one inventive feature, exceed 60 MN/m$^2$.

The interlayer is preferably comprised of a solid or liquid non-explosive material, e.g. rubber, plastic, water, or some other inert substance of low density, although at least 750 kg/m$^3$, and low shockwave pressure in response to a hollow charge jet impact.

The interlayer may alternatively comprise a semi-inert material, i.e. a material which when subjected to high pressure, e.g. a pressure in the order 1–2 GPa, gives rise to partial deflagration (combustion) or detonation. By partial is meant here that deflagration or detonation only takes place in the high pressure regions, i.e. does not propagate from these regions.

Examples of such semi-inert materials are various solutions of formaldehyde or its compounds, e.g. an aqueous solution of formaldehyde or a solution of formaldehyde in water and methanol, or alternatively a formaldehyde trimer (trioxane) or various forms of homopolymers or copolymers of polyoxymethylene (polyformaldehyde). Other substances rich in oxygen or halogens may also be used. Additional "acitivity" is achieved when readily sublimated substances are used, e.g. such as the aforesaid trioxane, or ethylene carbonate.

BRIEF DESCRIPTION OF THE DRAWINGS

The invention will now be described in more detail with reference to the accompanying drawings.

DESCRIPTION OF A PREFERRED EMBODIMENT

Figure 1:
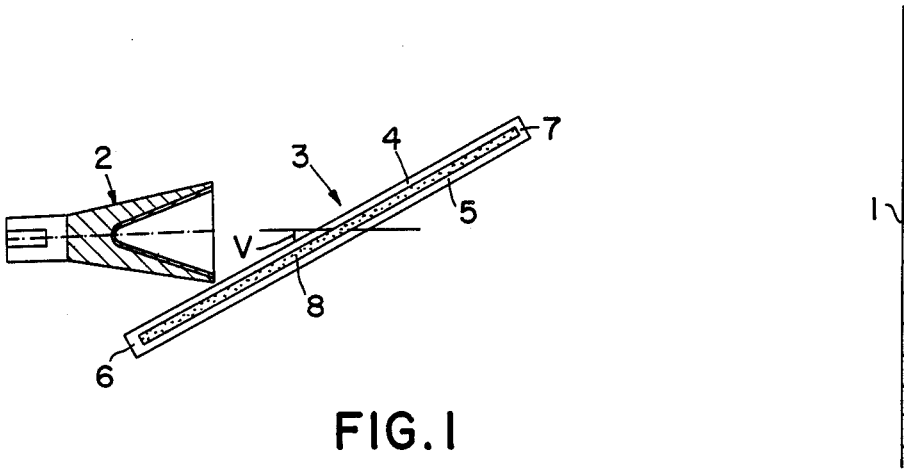
FIG. 1 illustrates a preferred embodiment of an inventive projective armour arrangement in a non-activated state.
Figure 2:
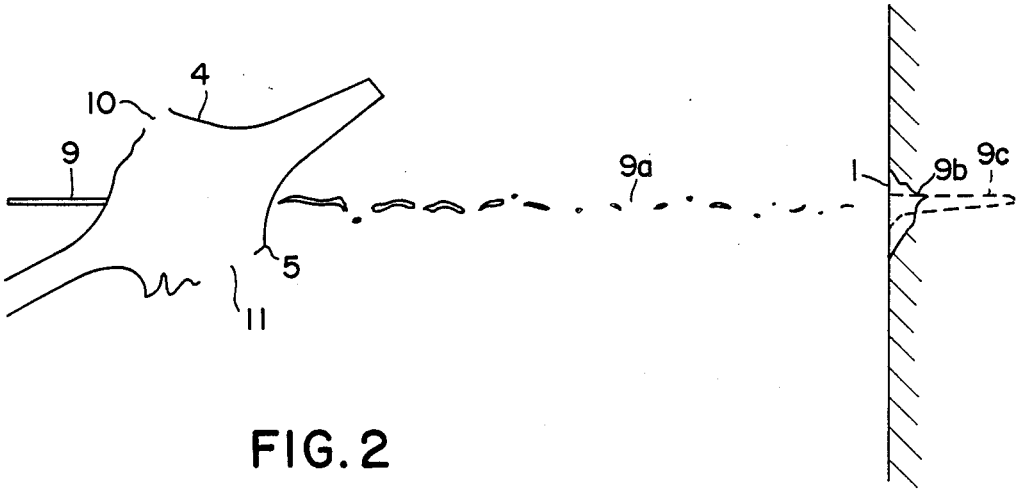
FIG. 2 illustrates the protective armour arrangement of FIG. 1 in an activated state.

FIGS. 1 and 2 illustrate schematically a "dynamic" protective armour arrangement which comprises one or more panels structures 3, of which only one is shown and this in cross-section. Each panel structure 3 comprises two mutually parallel plates 4 and 5 which are joined together in spaced apart relationship with the aid of joining strips 6 and 7 located at the edges of respective plates, such that all plates together form a container-like structure, the plates being of square configuration for example, and said plates and said strips being made, e.g. of steel. The container-like structure thus formed is filled with an inert substance, e.g. rubber, plastic or water, which forms the aforementioned interlayer.

When the hollow charge projectile 2 detonates, it generates, in a known manner, a hollow charge jet or thorn 9 which bores a hole 10 in the outer plate 4 and a hole 11 in the inner plate 5 of the container-like structure. The resultant shockwaves are reflected in the plates 4 and 5 in the aforedescribed manner, therewith to lift the plate material around the holes 10 and 11 forming conical or crater-like bulges at the hole-surrounds, as illustrated in FIG. 2. The jet or thorn is therewith degraded, as shown at 9*a*, and will penetrate the target 1 to be extent illustrated by reference 9*b* in FIG. 2. The reference 9*c* designates the extend to which a hollow charge jet would penetrate the target if the target were not protected by the inventive dynamic armour arrangement.

The movement executed by the plates 4 and 5 is illustrated more clearly in FIGS. 3*a–d*.

Figure 3A:
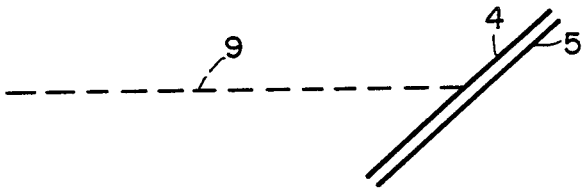
FIGS. 3*a–d* are schematic illustrations of four various stages of penetration of the hollow explosive charge jet into the protective armour arrangement
Figure 3B:
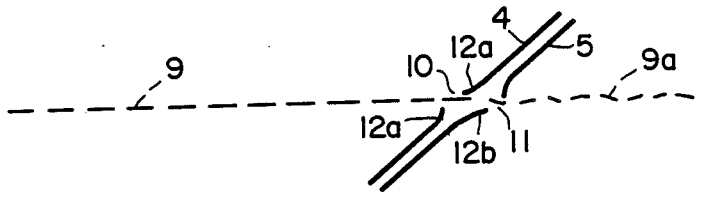
Figure 3C:
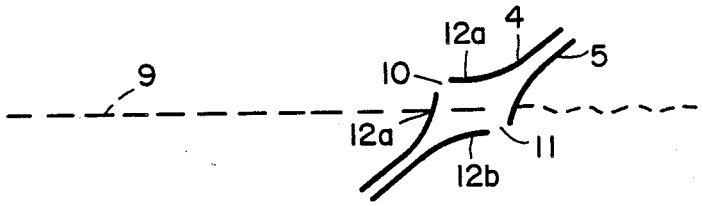

FIG. 3*a* illustrates a hollow explosive charge jet which impinges obliquely on the outer plate 4 of the protective armour arrangement. FIG. 3*b* shows how the jet will penetrate the plates 4 and 5, to form a hole 10 in the outer plate 4 and a hole 11 in the inner plate 5. As beforementioned, the hollow explosive charge jet is degraded, as illustrated at 9*a*. The shockwave forces in the plates 4 and 5 create crater-like bulges 12*a*, 12*b* in the plate material surrounding the respective holes 10 and 11, cf. FIG. 3*c*.

Figure 3D:
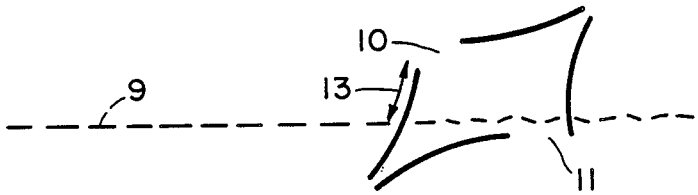
Figure 4:
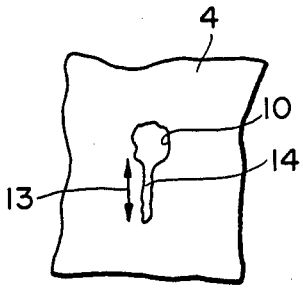
FIG. 4 illustrates from above a protective armour arrangement that has been penetrated by a hollow charge jet.

Because the plate material bulges around the holes 10, 11 in the aforesaid manner, fresh plate material will be progressively shifted into the path of the jet or thorn 9 as the bulges form. The length extension 13 in FIGS. 3*d* and 4 illustrates the extension of plate material moved into the path of the jet. The plates material contained in said displaced plate extension is sawn by the hollow charge jet in the manner illustrated at 14 in FIG. 4, said Figure illustrating schematically a fragment of the plate 4 and show the appearance of the hole 10 subsequent to cessation of the hollow charge jet.

We claim:

1. A reactive armour arrangement for protection against an obliquely impinging hollow explosive charge jet, comprising two mutually parallel metal plates which can be penetrated by the jet to form a hole in said two mutually parallel metal plates, and an interlayer of non-explosive formaldehyde compound located between said two mutually parallel metal plates, said interlayer being an incompressible material and having a density at most $\frac{1}{3}$ of a density of said two mutually parallel metal plates, and a major part of shockwaves generated by the hollow explosive charge jet in said two mutually parallel metal plates being reflected against said interlayer so that reflective forces give rise to forces which strive to move said two mutually parallel metal plates apart, and so that edges of said hole lift in a crater-like fashion therewith forcing material of said two mutually parallel metal plates around said edge of said hole to be shifted progressively into a path of the obliquely impinging hollow explosive charge jet and therewith progressively decreasing energy content thereof.

2. A protective armour arrangement according to claim 1, wherein a thickness of said two mutually parallel metal plates is between 2 and 20 mm, preferably between 2 and 10 mm, so as to provide a desired degree of lift around said edges of said hole.

3. A protective armour arrangement according to claim 1, wherein said interlayer has a density of at least 750 kg/m$^3$.

4. A protective armour arrangement according to claim 1, wherein said two mutually parallel metal plates are joined together at their respective edges by strips.

5. A protective armour arrangement according to claim 1, wherein a stress flow $\sigma_{0.2}$ of said mutually parallel metal plates exceeds 60 MN/m$^2$.

* * * * *